United States Patent [19]

Panek-Finda

[11] 3,970,583

[45] July 20, 1976

[54] ISOTOPE GENERATOR PROVIDED WITH A CARRIER MATERIAL WHICH IN ADDITION TO $AL_2O_3$ CONTAINS FULLY OR PARTLY HYDRATED $MNO_2$

[75] Inventor: Helena Panek-Finda, Weesp, Netherlands

[73] Assignee: U.S. Philips Corporation, New York, N.Y.

[22] Filed: Feb. 14, 1974

[21] Appl. No.: 442,473

[30] Foreign Application Priority Data

Feb. 20, 1973 Netherlands ..... 7302304

[52] U.S. Cl. ..... 252/301.15; 23/252 R; 252/301.1 R; 423/2

[51] Int. Cl.[2] ..... G21G 4/04

[58] Field of Search ..... 252/301.1 R, 301.15; 423/2, 249; 23/252 R

[56] References Cited

UNITED STATES PATENTS 3,785,990 1/1974 Benjamins et al..... 252/301.1 R

OTHER PUBLICATIONS

Meloni, S. et al. "A New Technetium-99m Generator Using Manganese Dioxide" Intl. J. App. Rad. & Isotopes. vol. 19, No. 2, pp. 164–166.

*Primary Examiner*—Richard D. Lovering
*Assistant Examiner*—Deborah L. Kyle
*Attorney, Agent, or Firm*—Frank R. Trifari; Norman N. Spain

[57] ABSTRACT

The invention relates to an isotope generator for the production of liquids containing $99^{m}Tc$ wherein the adsorbent used in the generator contains $Al_2O_3$ and at least partially hydrated manganese dioxide.

8 Claims, 1 Drawing Figure

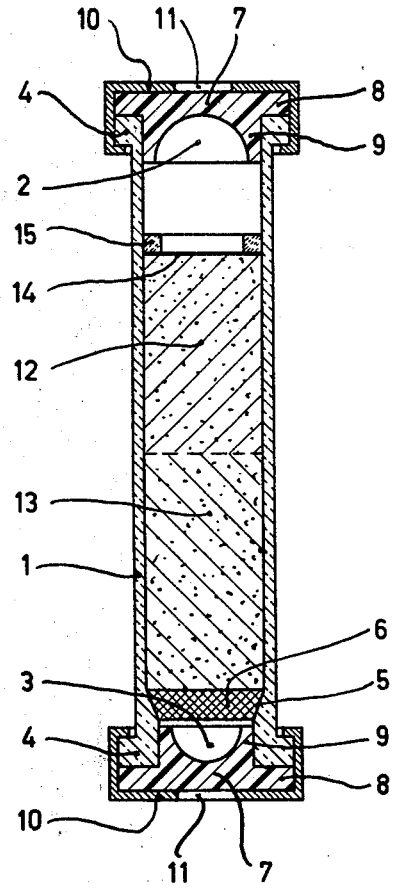
10
11
7
4
8
9
2
15
14
12
13
1
6
3
5
4
9
8
10
11
7

ISOTOPE GENERATOR PROVIDED WITH A CARRIER MATERIAL WHICH IN ADDITION TO $AL_2O_3$ CONTAINS FULLY OR PARTLY HYDRATED $MNO_2$

The invention relates to an isotope generator for the production of liquids containing 99m Tc. The radioisotope 99m Tc is suitable for medical diagnostic purposes on account of the emission of $\gamma$-radiation and its short half-life. The radioactive technetium isotope may then be used as such but also for radioactively labelling other substances such as proteins and sulphur colloids. The 99m Tc isotope is produced by the radioactive decay of 99m Mo, the latter being referred to hereinafter as the parent isotope.

A conventional embodiment of an isotope generator which produces 99m Tc comprises a reservoir provided with an inlet and an outlet opening, which contains a carrier material or absorbing material for the parent isotope.

During use of the generator a washing liquid or eluant is admitted via the inlet opening at the top. The eluant subsequently passes through the carrier material, thereby taking along the amount of daughter isotope present in the carrier material. The eluant thus provided with a daughter isotope (99m Tc) leaves the generator at the bottom via the outlet opening and is collected in a receptacle which is preferably connected to the outlet opening. The liquid containing 99m Tc is also termed eluate. The entire process of administering the eluant and collecting the eluate is called milking by those skilled in the art and is also known by the name elution process. The selection of the carrier material, chemical formulation of parent isotope and daughter isotope as well as the choice of the washing liquor must be such that during elution only the daughter isotope is extracted by the washing liquor and little or none of the parent isotope is removed by the eluant. In a 99m Tc generator $Al_2O_3$ is frequently used as a carrier or absorbing material. The parent isotope is applied on the $Al_2O_3$ carrier material as a molybdate, for example an alkali metal molybdate. The 99m Tc produced by the radioactive decay of the parent isotope then has the form of pertechnate. As washing liquor one generally uses a physiological salt solution.

Such a 99m Tc generator is, inter alia, known from Netherlands patent application No. 7,102,716 (which corresponds to U.S. Pat. No. 3,785,990). Said application states that the efficiency of the generator, i.e., the ratio of the quantity of 99m Tc obtained by an elution process to the quantity of 99m Tc present in the carrier material, is often very low and, moreover, fluctuates substantially. This is particularly so in the case of a high activity level of the generator, i.e. when comparatively large quantities of 99m Mo and 99m Tc are present. In order to mitigate this drawback it is desirable according to the said patent application to treat the carrier material after the application of the parent isotope with an oxidizing agent which is firmly bound to the carrier material. As examples of suitable oxidizing agents chromates and bichromates are mentioned.

Tests have demonstrated that by the application of the step described in the said Netherlands patent application the average efficiency of a Tc-generator could be raised to over 80%. To obtain eluates with a sufficiently high concentration of 99m Tc and a sufficiently high radioactivity level, it is obvious that in addition to the efficiency the amount of 99m Tc present in the carrier material is of importance. This means that a sufficient amount of 99m Mo in the form of a molybdate must be deposited onto the carrier material. Until now the $Al_2O_3$ carrier material, in order to obtain a satisfactory absorption degree with respect to 99m Mo-molybdate, was pretreated with an aqueous solution of a strong acid such as 4 N.$HNO_3$. This pretreatment creates active spots on and in the carrier material which allow the subsequently added molybdate to be bound. However, the necessary pretreatment has the drawback that in the carrier material $Al^{+++}$ ions may be present which during use of the generator come into the eluate. As an example, tests have revealed that on an average 60–100 $\mu$g of $Al^{+++}$ ions are present in the eluate of a 99m Tc generator. The $Al^{+++}$ ions may have a highly disturbing effect during the subsequent processing of the eluate, for example, if the eluate is used for radioactively labelling sulphur colloids. Thus the sulphur colloid will be comparatively unstable due to the presence of $Al^{+++}$ ions and will readily flocculate. A further disadvantage of the pretreatment is that the pH of the eluates obtained during use of the generator is comparatively low. Tests have revealed that the pH varies between the values 3.8 and 4.5. Such an acidly reacting eluate cannot be readily used in radio diagnosis.

The invention provides a generator of the type mentioned in the preamble which does not have such drawbacks. More in particular, the invention relates to an isotope generator for the production of liquid containing 99m Tc, which is provided with a reservoir having an inlet and an outlet opening and containing a carrier material for the parent isotope 99m Mo, the carrier material containing $Al_2O_3$ and the parent isotope 99m Mo being present in the form of a molybdate, and is characterized in that the carrier material also contains hydrated or partly hydrated manganese dioxide.

Surprisingly, it has been found that the carrier material used in the generator according to the invention, as such, that is without previous treatment with a strong acid, already has an absorption degree for molybdate which equals and even exceeds that of the carrier material used in the known generator. For example, by means of the carrier material of the generator according to the invention an absorption capacity of 56.2 mg of Mo in the form of a molybdate per gramme of carrier material was obtained. With the carrier material used in the known generator an absorption capacity of 55.3 mg Mo per gram of carrier material was obtained. Since the carrier material of the generator according to the invention requires no previous treatment with a diluted strong acid, no more $Al^{+++}$ ions will occur in the eluate when using the generator. Furthermore, the pH value of the eluate is very favourable, ranging between 6 and 7.3.

The investigation underlying the invention has furthermore revealed that by means of the generator according to the invention excellent elution efficiencies with an average value of 84.4%, are obtainable. Moreover, it has been found that with the generator according to the invention eluates are obtained in which the radioactivity is strongly concentrated or, in other words, in which a high 99m Tc concentration exists. As an example, tests have revealed that during an elution process more than 95% of the total 99m Tc radioactivity obtained were contained in the first 10 ml of the eluate. Tests with the generator provided with potassium bichromate according to the previously cited Netherlands Patent Application showed that over 95% of the eluted activity were contained in the first 15 ml of the eluate. Furthermore, it is to be borne in mind that with this known generator a post-treatment of the carrier material with a chromate or bichromate solution is required. Post-treatment is to be understood to mean a treatment which takes place after the generator has been provided with activity. Such a post-treatment, which involves extra manipulation with radio-active material, is dispensed with in the generator according to the present invention.

Furthermore, it is to be noted that the Int. Journ. of Appl. Rad. and Isotopes 19, p. 164 – 166 (1968) describes a 99m Tc generator using a carrier material consisting of manganese dioxide for the parent isotope. The absorption capacity of this carrier material is low and amounts to 5.8 mg of Mo per gramme of carrier material, so that when using this known generator eluates with a low 99m Tc concentration are obtained. For this reason such eluates are less suitable for diagnostic applications. Compared to this the high absorption capacity of the carrier material of the generator according to the invention, which amounts to 56.2 mg of Mo per gramme of carrier material may be characterized is highly surprising. Another drawback of said known generator is that in case of elution with a physiological salt solution only 55% of the 99m Tc radioactivity are contained in the first 10 ml of the eluate. With the generator according to the invention more than 95% of the activity are contained in the first 10 ml of the eluate.

In a favourable embodiment of the generator according to the invention the carrier material consists of $Al_2O_3$ particles of which at least a fraction is entirely or partly covered with a layer of hydrated of partially hydrated manganese dioxide. Such particles which are fully or partly coated with hydrated manganese dioxide can be prepared by methods known per se. For example, hydrated manganese sulphate may be added to $Al_2O_3$ particles, after which the slurry thus obtained is heated at 90°C and subsequently an aqueous permanganate solution is added dropwise. It is also possible to add an aqueous permanganate solution to $Al_2O_3$ particles and then dropwise add a 30% hydrogen peroxide solution.

In a further suitable embodiment of the generator according to the invention the column of carrier material present in the reservoir consists of a top layer situated at the side of the inlet opening and a bottom layer situated at the side of the outlet opening. The upper layer contains $Al_2O_3$ particles which are fully or partly coated with hydrated or partially hydrated manganese dioxide. The bottom layer consists of $Al_2O_3$ particles which contain no manganese dioxide. The ratio between the weight of the upper layer and the lower layer may vary within wide limits. Satisfactory results are obtained when the quantity of the upper layer is 30 – 60 % by weight of the total quantity of carrier material. Furthermore, it has been found that per gramme of $Al_2O_3$ the carrier material should preferably include an amount of hydrated or partially hydrated manganese dioxide which corresponds to 1.5 – 4 mg of manganese. For smaller quantities the efficiency decreases to a value lower than 80%. For greater quantities the eluate will become contaminated with manganese. For the sake of clarity, it is pointed out that when the generator has a carrier material consisting of an upper and lower layer, the said quantities of manganese dioxide apply to the upper layer.

In a preferred embodiment of the generator according to the invention an amount of hydrated or partially hydrated manganese dioxide is provided per gramme of $Al_2O_3$, which corresponds to 2.2 – 3 mg of manganese.

In a further suitable embodiment of the generator according to the invention the reservoir is constituted by an open-ended cylindrical body whose openings are covered by pierceable rubber stops, the carrier material in the reservoir being enclosed between filters which are situated at the top and bottom of the carrier material in the reservoir. By means of this embodiment sterile eluates containing 99m Tc can be obtained. Moreover, owing to the closure by means of rubber stoppers, the radiation hazard is reduced. When using such a generator the washing liquid can be administered to the carrier material in a simple and effective manner via a hollow injection needle which is inserted through the upper rubber stopper. The eluate is also collected via a hollow injection needle which is inserted through the lower rubber stopper. Further, if the latter injection needle is connected to a receptacle which is evacuated, known by the name of vacuum bottle, a good flow of the washing liquid through the carrier material can be obtained in a simple manner.

Upon delivery to the user, the generator is already provided with the radioactive parent isotope, so that the user can extract liquid containing 99m Tc from the generator by means of an elution process at any desired moment.

Loading the generator with the radioactive parent isotope 99m Mo in the form of, for example, sodium molybdate is effected as follows. First of all, the carrier material is treated with an isotonic salt solution (0.9% of NaCl solution in water). After this so-called conditioning an aqueous solution of sodium molybdate containing 99m Mo, which contains 40 mg of molybdenum per ml is added via the inlet opening of the reservoir to the carrier material present in said reservoir. The pH of the solution may vary between 1.5 and 3.5. Subsequently, the generator is flushed with an isotonic salt solution, after which the inlet and outlet openings of the reservoir are closed with for example rubber stoppers and finally the generator is sterilized in an autoclave at a temperature of 120°C. It is to be noted that the inlet and outlet openings of the reservoir may already be provided with rubber stoppers when administering the radioactive molybdate solution. In that case administration is effected via a hollow injection needle inserted through the rubber stopper.

The invention will now be described in more detail by way of example, with reference to the drawing.

The FIGURE shows a cross-sectional view of a suitable embodiment of the isotope generator according to the invention. The generator is already provided with the parent isotope 99m Mo and ready for use.

The reference numeral 1 in this Figure refers to a reservoir which is provided with an inlet opening 2 at the top and an outlet opening 3 at the bottom. The reservoir is substantially cylindrical and is provided with a flange position 4 at either end. In the lower part of the reservoir has an internal diameter transition 5. At the location of the diameter transition 5 the reservoir 1 is provided with a trapezoidal glass filter 6. The openings 2 and 3 of the reservoir are closed by a rubber stopper 7 which comprises a flange portion 8 and a jacket portion 9. The jacket portion 9 fits the openings of the reservoir 1, whilst the flange portion 8 engages the flange portion 4 of the reservoir 1. The flange portion 8 of the stopper 7 and the flange portion 4 of the reservoir 1 are connected to each other by means of a metal capsule such as an aluminium capsule 10. The capsule 10 has an opening 11. The reservoir 1 contains a carrier material for a parent isotope. Said carrier material consists of an upper layer 12 and a lower layer 13. The upper layer 12 contains $Al_2O_3$ particles which are entirely or partially coated with a layer of hydrated or partially hydrated manganese dioxide. The lower layer 13 consists of $Al_2O_3$ particles. The total weight of the carrier material is for example 7 grammes, of which 3 grammes are contained in the upper layer. In the reservoir the carrier material is enclosed between the glass filter 6 and a micropore filter 14 which is pressed against the carrier material by means of a washer 15. The upper layer 12 contains the radioactive parent isotope 99m Mo in the form of an alkali metal molybdate such as sodium molybdate.

When using the isotope generator according to the invention shown in the Figure a washing liquid such as a physiological salt solution is admitted at the top via a hollow injection needle inserted through the upper rubber stopper 7. The washing liquid passes through the micropore filter 14 and subsequently through the upper layer 12 of the carrier material. In said upper layer the parent isotope 99m Mo in the form of sodium molybdate on the carrier material is absorbed. Owing to radioactive decay of 99m Mo the upper layer will also contain 99m Tc in the form of sodium pertechnate. The washing liquid absorbs the pertechnate containing the 99m Tc and subsequently passes through the lower layer 13 of the carrier material. After having passed the filter 6 the washing liquid with 99m Tc is collected in a receptacle via an injection needle inserted through the lower rubber stopper 7. The radioactive eluate thus obtained is of a high chemical purity, i.e. it contains no contaminations such as $Al^{+++}$ ions, it has a pH value of 6.5 – 7.5 and is directly suited for use in medical diagnosis.

What is claimed is:

1. In an isotope generator for the production of liquids containing 99 mTc which generator is provided with a reservoir having an inlet opening and an outlet opening and a parent isotope 99 mMo in the form of a molybdate on a carrier material located in said reservoir the improvement wherein the carrier material contains $Al_2O_3$ and at least partially hydrated manganese dioxide.

2. The isotope generator of claim 1 wherein the carrier material is in the form of $Al_2O_3$ particles at least a fraction of which is at least partially coated with at least partially hydrated manganese dioxide.

3. The isotope generator of claim 2 wherein for each gram of $Al_2O_3$ from 1.5 to 4 mgs of manganese in the form of at least partially hydrated manganese dioxide is present.

4. In an isotope generator for the production of liquids containing 99 mTc which generator is provided with an inlet opening and an outlet opening and a parent isotope 99 mMo in the form of a molybdate on a carrier material located in said reservoir the improvement wherein the carrier material consists of an upper layer at the side of the inlet opening containing $Al_2O_3$ particles at least partially coated with a layer of at least partially hydrated manganese dioxide and a lower layer situated at the side of the outlet opening consisting of $Al_2O_3$ particles.

5. The isotope generator of claim 4 wherein 30–60% by weight of the carrier material is present in the upper layer.

6. The isotope generator of claim 4 wherein in the upper layer of the carrier material for each gram of $Al_2O_3$ there is present from 1.5 to 4 mg of manganese in the form of at least partially hydrated manganese dioxide.

7. The isotope generator of claim 6 wherein for each gram of $Al_2O_3$ from 2.2 to 3 mg of manganese in the form of at least partially hydrated manganese dioxide is present.

8. The isotope generator of claim 4 wherein the reservoir is in the form of an open-ended cylindrical body the openings of which are closed by pierceable rubber stoppers and the carrier material in the reservoir is enclosed between filters located at the top and bottom of the carrier material in the reservoir.

* * * * *